United States Patent [19]

Jacquot

[11] Patent Number: 4,580,120

[45] Date of Patent: Apr. 1, 1986

[54] FERROMAGNETIC STRUCTURE OF AN ION SOURCE PRODUCED BY PERMANENT MAGNETS AND SOLENOIDS

[75] Inventor: Bernard Jacquot, Saint Egreve, France

[73] Assignee: Commissariat a l'Energie Atomique, Paris, France

[21] Appl. No.: 645,442

[22] Filed: Aug. 29, 1984

[30] Foreign Application Priority Data

Aug. 30, 1983 [FR] France ..... 83 13886

[51] Int. Cl.[4] ..... H01F 7/00

[52] U.S. Cl. ..... 335/301; 335/214

[58] Field of Search ..... 335/210, 212, 211, 214, 335/301, 306

[56] References Cited

PUBLICATIONS

Revue de Physique Appliquee, vol. 15, No. 5, May 1980, Paris (FR), R. Geller et al.: "Micromafios source d'ions multicharges basee sur la resonance cyclotronique des electrons", pp. 995–1005, *1001, colonne 2, lignes 17–24; figure 9 *.

IEEE Transaction on Plasma Science, vol. PS-6, No. 4, Dec., 1978, J. T. Crow et al.: "High Performance, Low Energy Ion Source", pp. 535–538, *p. 535, colonne 2, lignes 1–8; figure 1a *.

Nuclear Instruments and Methods, vol. 92, No. 2, Mar. 15, 1971, Amsterdam (NL), A. Isoya et al.: "A Beam Injection system for the Terminal Ion source of the Electrostatic Generator", pp. 215–220, * figure 6 *.

Helvetia Physica Acta, vol. 47, No. 4, 1974 Bale (CH), A. Chielmetti et al.: "Ein Energie-Massen-Spektrometer zur Messung des Magnetosphaerischen Plasmas", pp. 473–477, * p. 474, lignes 10–13 *.

*Primary Examiner*—George Harris

*Attorney, Agent, or Firm*—Pearne, Gordon, Sessions, McCoy, Granger & Tilberry

[57] ABSTRACT

Ferromagnetic structure of an ion source produced by permanent magnets and solenoids.

In the ferromagnetic structure according to the invention, the system of solenoids is shielded on the outside of the useful volume of the source by a first ferromagnetic casing, the permanent magnets being mounted on the inner walls of a second casing shaped like a cylinder and made from ferromagnetic material, in order to channel the magnetic fluxes outside the useful volume into a ferromagnetic structure, the two casings being separated from one another by a material ensuring an adequate reluctance between the two ferromagnetic circuits.

3 Claims, 3 Drawing Figures

FERROMAGNETIC STRUCTURE OF AN ION SOURCE PRODUCED BY PERMANENT MAGNETS AND SOLENOIDS

BACKGROUND OF THE INVENTION

The present invention relates to a ferromagnetic structure of an ion source produced by permanent magnets and solenoids. It is applicable in ion sources of the electron cyclotron resonance type, where it confines the plasma of a gas or vapour in which the ions are produced by impacts of ionizing electrons.

U.S. Pat. No. 4,417,178, filed in the name of the Commissariat à l'Energie Atomique describes a heavy ion source of the ECR type (electron cyclotron resonance), called "Micromafios", in which the magnetic confinement configuration of the plasma is produced by the superimposing of a magnetic induction with an axial component produced by solenoids and an induction with a radial component produced by permanent magnets based on rare earths (such as e.g. samarium-cobalt).

The useful volume to be magnetized is approximately 1 liter. The electric power consumption of the solenoids is approximately 100 kW, i.e. relatively high for ensuring a maximum induction of 0.5 Tesla in this useful volume.

There is still an internal demagnetizing field superimposed on the external field of a straight permanent magnet, whose origin is the reclosing of the magnetic flux between the opposing poles. This situation makes it necessary to arrange sufficiently long magnetized bars to minimize the influence of the opposing pole in the useful volume.

FIG. 1 shows the configuration of the permanent magnets according to the prior art in the Micromafios source.

In the case of the magnetic structure of the source according to the aforementioned patent, the magnets 1 have a length L of 7 cm to obtain 90% of the magnetic induction in the useful volume 2. In theory, it would by necessary to have a bar of infinte length L to obtain 100% of this maximum induction. The volume of this configuration, as well as the quantity of magnetized material are high in this magnetic structure.

SUMMARY OF THE INVENTION

The object of the invention is to obviate these disadvantages and more particularly to reduce the electric power consumption and the quantity of magnetized material used for supplying the magnetic field in the useful volume of the ion source. To this end, it is proposed that the magnetic flux is reclosed outside the useful volume of an ion source in a ferromagnetic structure, in such a way that the magnetic field only expands in the useful volume.

More specifically, the present invention relates to a magnetic structure for the confinement of a plasma in an electron cyclotron resonance ion source produced by superimposing an axial magnetic induction supplied by solenoids and a radial induction supplied by permanent magnets, wherein the system of solenoids is shielded on the outside of the useful volume of the source by a first ferromagnetic casing, the permanent magnets being mounted on the inner walls of a second casing shaped like a cylinder and made from ferromagnetic material, in order to channel the magnetic fluxes outside the useful volume into a ferromagnetic structure, the two casings being separated from one another by a material ensuring an adequate reluctance between the two ferromagnetic circuits.

According to another feature, the permanent magnets are only fixed to the inner wall of the ferromagnetic cylinder by magnetic adhesion.

According to another feature, the casings are made from soft iron.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
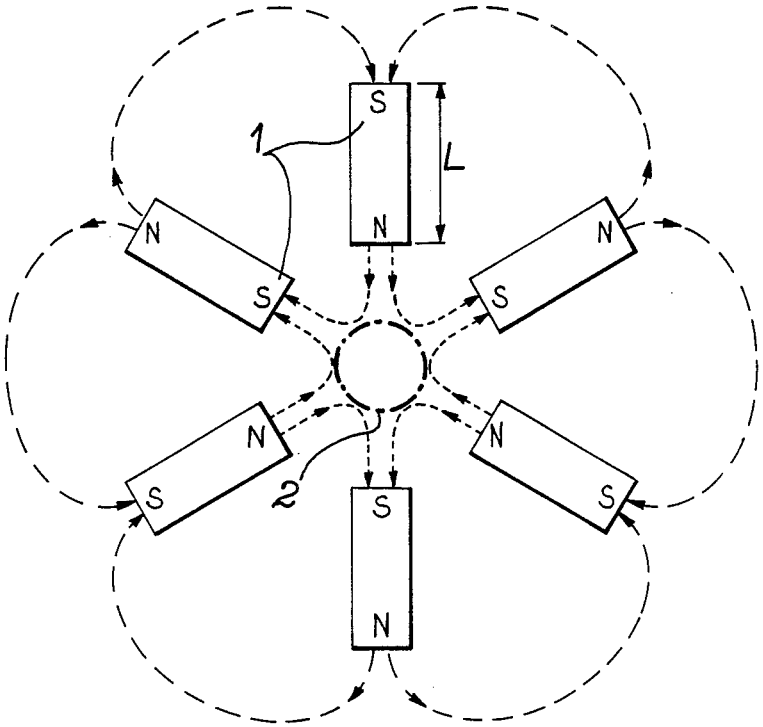
FIG. 1 already described, diagrammatically and in section, the configuration of the permanent magnet supplying the radial magnetic field according to the prior art.
Figure 2:
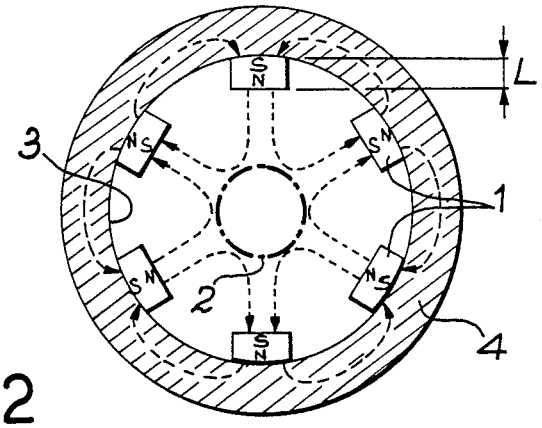
FIG. 2 diagrammatically and in section, the configuration of the permanent magnets fitted to a cylinder of a ferromagnetic material according to the invention.

FIG. 2 shows in section, the configuration of the permanent magnets according to the invention supplying the radial magnetic field. The permanent magnets 1, which are preferably of samarium-cobalt, are fixed solely by their magnetic adhesion to the inner wall 3 of a ferromagnetic material cylinder 4. As required, the radial magnetic structure can be quadrupolar, hexapolar, octopolar, etc. Through reclosing the external flux in a circuit made from iron or some other ferromagnetic material makes it possible to eliminate the contribution of the opposing pole and consequently to reduce the length of the magnetized bar 1, i.e. 100% of the induction produced by the magnets is available in the useful volume.

In theory, length L could be very small, but in practice a length of about 1 cm remains necessary, due to the intrinsic imperfections of the magnets (leakage fields). Thus, compared with the prior art, magnetized material can be economized by a factor of 5. In addition, the overall dimension of the radial magnetic configuration are reduced.

Figure 3:
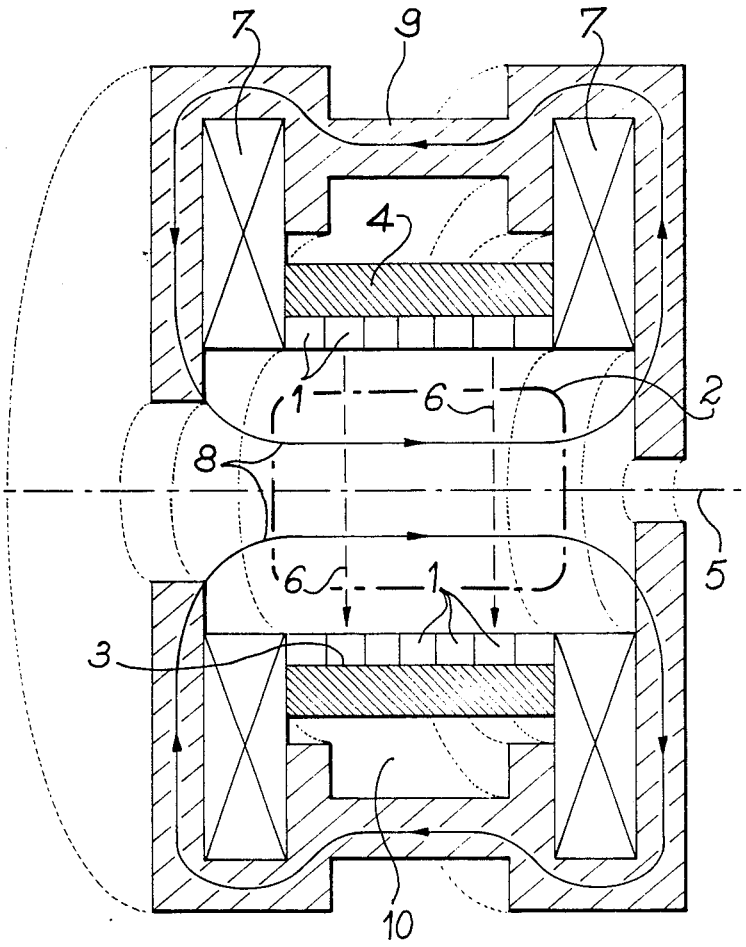
FIG. 3 diagrammatically and in section along the central axis, the complete magnetic structure according to the invention.

FIG. 3 shows in sectional form along central axis 5, the complete magnetic structure according to the invention, i.e. the configuration of the multipolar radial magnetic field 6 constituted by the permanent magnet 1, fitted to the inner wall 3 of cylindrical casing 4. At the two ends of the cylinder are provided two coils 7, which supply the axial magnetic field 8. Outside the useful volume 2 of the ion source, the two solenoid coils are shielded by a ferromagnetic casing 9.

The two casings 4 and 9 are separated by a material 10 having an adequate reluctance. For example, the material can be constituted by an air layer having a thickness of approximately 1 cm, or preferably by a layer of a plastic material, such as polyvinyl chloride (PVC) with a thickness of 1 cm, said material also ensuring the electrical insulation between the two ferromagnetic circuits.

The magnetic insulation 10 between the two casings 4 and 9 is important, because the ferromagnetic casing 4 must be neither saturated nor disturbed by the axial induction 8.

Due to the magnetic shielding, the ampere-turns of the solenoid coil 7 only serve to magnetize the useful volume 2, which makes it possible to reduce the electricity consumption by a factor of 3 to 4 compared with the prior art configurations, which makes it possible to more easily install the ion source on a platform raised to a very high voltage.

What is claimed is:

1. A magnetic structure for the confinement of a plasma in an electron cyclotron resonance ion source produced by superimposing an axial magnetic induction supplied by solenoids and a radial induction supplied by permanent magnets, wherein the system of solenoids is shielded on the outside of the useful volume of the source by a first ferromagnetic casing, the permanent magnets being mounted on the inner walls of a second casing shaped like a cylinder and made from ferromagnetic material, in order to channel the magnetic fluxes outside the useful volume into a ferromagnetic structure, the two casings being separated from one another by a material ensuring an adequate reluctance between the two ferromagnetic circuits.

2. A magnetic structure according to claim 1, wherein the permanent magnets are fixed to the inner wall of the ferromagnetic cylinder solely by their magnetic adhesion.

3. A magnetic structure according to claim 1, wherein the casings are made from iron.

* * * * *